United States Patent [19]

Mizutani et al.

[11] Patent Number: 4,629,849

[45] Date of Patent: Dec. 16, 1986

[54] MICROWAVE HEATING DEVICE HAVING A ROTARY REFLECTOR MEANS IN A HEATING CHAMBER

[75] Inventors: Isao Mizutani, Nagoya; Tsunezo Takeuchi, Aichi, both of Japan

[73] Assignee: NGK Insulators Ltd., Japan

[21] Appl. No.: 748,621

[22] Filed: Jun. 25, 1985

[30] Foreign Application Priority Data

Jun. 28, 1984 [JP] Japan ..... 59-97616[U]
Jun. 28, 1984 [JP] Japan ..... 59-97617[U]
Jun. 28, 1984 [JP] Japan ..... 59-97618[U]

[51] Int. Cl.[4] ..... H05B 6/72
[52] U.S. Cl. ..... 219/10.55 F; 219/10.55 A
[58] Field of Search ..... 219/10.55 F, 10.55 A, 219/10.55 R

[56] References Cited

U.S. PATENT DOCUMENTS 3,436,507 4/1969 Püschner ..... 219/10.55 F
3,916,137 10/1975 Jurgensen ..... 219/10.55 A
3,965,325 6/1976 Hirai ..... 219/10.55 F X
4,176,266 11/1979 Kaneko et al. ..... 219/10.55 F
4,185,181 1/1980 Kaneko et al. ..... 219/10.55 F
4,289,945 9/1981 Kristof ..... 219/10.55 F
4,329,557 5/1982 Staats ..... 219/10.55 F
4,421,968 12/1983 Osepchuk ..... 219/10.55 F

*Primary Examiner*—Philip H. Leung
*Attorney, Agent, or Firm*—Parkhurst & Oliff

[57] ABSTRACT

A microwave heating device for heating a material in a heating room by microwave radiation produced by a microwave oscillator. The heating device includes an outer waveguide for channeling the microwave radiation from the microwave oscillator into the heating room. The outer waveguide is connected at a first end to the heating room. The microwave heating device also includes a rotary reflector unit disposed adjacent to the first end of the outer waveguide, for uniformly distributing the microwave radiation in the heating room. The rotary reflector unit includes a reflector member positioned to receive the microwave radiation from the outer waveguide for reflecting the microwave radiation, and a drive device for rotating the reflector member to cause irregular reflection of the microwave radiation.

7 Claims, 11 Drawing Figures

16

32
2
20
18
26
26
24
28
38
22
36
34
30
θ
4

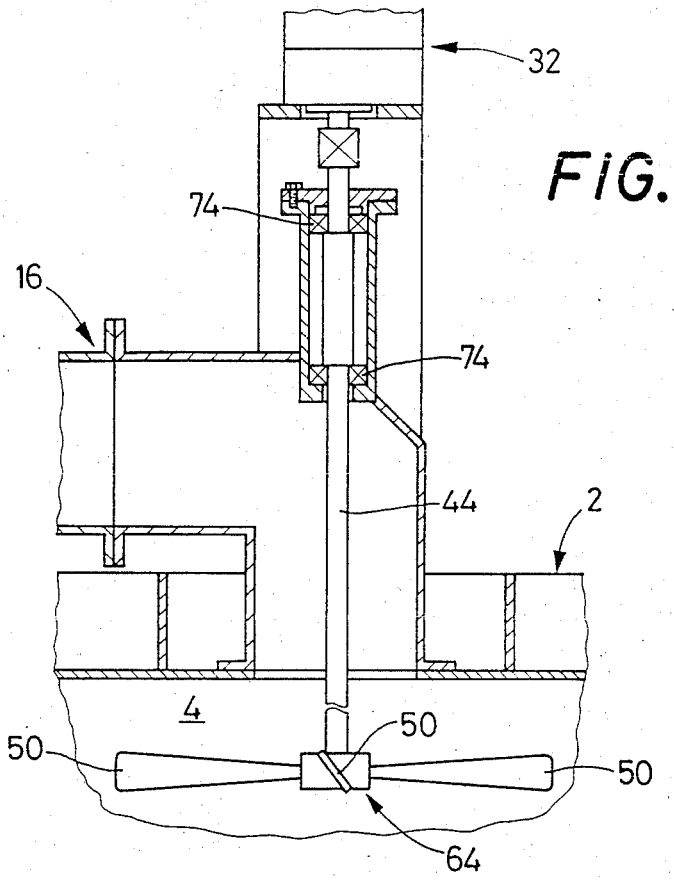
FIG. 8
FIG. 9
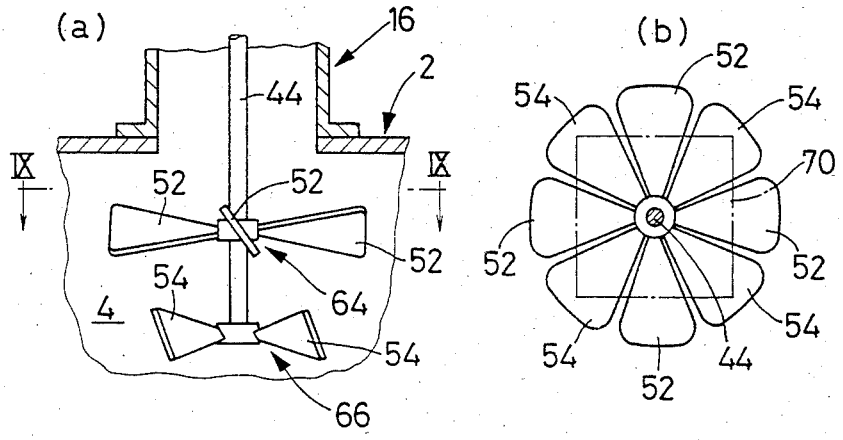

MICROWAVE HEATING DEVICE HAVING A ROTARY REFLECTOR MEANS IN A HEATING CHAMBER

BACKGROUND OF THE INVENTION

1. Field of the Art

The present invention relates in general to a microwave heating device or apparatus, and more particularly to such heating device for irradiating dielectric or non-conducting material such as food, wood, fibers, and ceramics by means of microwave radiation which is channeled or conducted through a waveguide toward the materials, to thereby heat and dry the materials.

2. Related Art Statement

A microwave heating device or apparatus is known in the art, which includes a microwave oscillator to produce microwave radiation, and a waveguide for channeling or conducting the microwave radiation from the oscillator into a heating room or chamber to irradiate and thereby heat non-conducting or dielectric materials or substances such as food, wood, fibers and ceramics by means of the microwave radiation introduced into the heating chamber. Generally, the materials to be heated are placed on a platform or stand provided in the heating chamber, and the platform with the materials placed thereon is rotated. In the meantime, the heating chamber is formed with an opening to which one end of the waveguide is connected for introducing the microwave radiation into the heating chamber. In such microwave heating devices, a fan or fans (rotary blades) are provided in the heating chamber, so that the microwaves radiated from the end of the waveguide into the heating chamber are irregularly reflected in the chamber so as to obtain uniform distribution of the microwave radiation for even irradiation of the material to be heated.

However, the above-indicated known microwave heating devices suffer some inconveniences which will be described. That is, the fans disposed in the heating chamber for stirring or dispersing the incident microwave radiation will not cause sufficient irregular reflection of the microwave radiation in the heating chamber, i.e., will not permit uniform distribution of the microwaves for even irradiation of the materials to be heated. In other words, the provision of such fans is not satisfactory for even or uniform heating of the material by the microwave radiation. Uneven heating and drying of the material, for example, will result in unveven moisture distribution of the processed article, which is a drawback that requires a solution for quality control of the article.

In the case where the microwave heating device is provided with a material platform which is rotatable, the drive system for rotating the platform is very much complicated, particularly when the microwave heating process is effected in a continuous fashion while the materials to be heated are fed in succession. In this particular case of continuous feeding of the materials, the connection of the material feeding system and the waveguide to a production line makes the heating equipment as a whole considerably large-sized, requiring a relatively large installation space for the equipment. Consequently, the productivity per unit area of the installation space is reduced, while the equipment cost, and operating and maintenance costs of the equipment are increased. Further, the need of a complicated drive system for the rotary material platform leads to reduced surface area on the platform for accommodating the materials. Moreover, there are materials or articles the size or configuration of which does not permit the materials to be rotated by a rotary type platform. Fundamantally, the microwave heating device with a rotary material platform is not applicable to such kinds of materials.

SUMMARY OF THE INVENTION

It is accordingly an object of the present invention to provide a microwave heating device which is capable of uniform distribution of microwave radiation for even irradiation of a material on a platform which is not rotated.

According to the present invention, there is provided a microwave heating device for heating a material in a heating room by means of a microwave radiation produced by a microwave oscillator, comprising an outer waveguide for channeling or conducting the microwave radiation from the microwave oscillator into the heating room, the outer waveguide being connected at one end thereof to the heating room, the microwave heating device further comprising rotary reflector means, disposed adjacent to the one end of the outer waveguide, for uniformly distributing the microwave radiation in the heating room. The rotary reflector means includes a reflector member positioned to receive the microwave radiation from the outer waveguide for reflecting the microwave radiation, and drive means for rotating the reflector member to cause irregular reflection of the microwave radiation.

In the microwave heating device of the invention constructed as described above, the rotating reflector member causes the incident microwave radiation to be irregularly reflected and thus uniformly distributed in the heating room, whereby the material is evenly irradiated and consequently evenly heated by the microwaves of uniform distribution. When the material is heated and dried, for example, the instant device makes it possible to obtain even distribution of moisture throughout the dried article, thereby obviating conventional inconveniences due to local drying of the material. In particular, the even or uniform heating and drying by the instant heating device is effective to ceramic materials which are fired into thin-walled structures. Namely, the defects of the ceramic articles due to local drying of the material, such as burning or breakage, may be effectively minimized according to the present invention.

In addition, the above-described arrangement makes it possible to eliminate the need of using a rotary material platform, and consequently the need of a drive mechanism for rotating the platform. As a result, the materials to be heated may be arranged at reduced itervals, and the number of the materials per unit area may be considerably increased. According to the annalysis of the inventors, the instant microwave heating device enjoys about 30 percent increase in the number of materials per unit area, as compared with a conventional device equipped with a rotary platform. Further, the elimination of a rotary drive mechanism for the material platform contributes to constructional simplification, and reduction in size and equipment cost, of the heating device as a whole.

In addition, the microwave heating without rotational movements of the platform allows even irradiation of long material such as lumber, that are impossible to rotate, or of such materials whose configurations are not susceptible to rotation. Thus, a wide variety of materials may be suitably heated into desired articles with enhanced quality. These are some of the industrially significant aspects of the invention.

According to an advantageous embodiment of the invention, the reflector member comprises an inner waveguide projecting a predetermined distance from the one end of the outer waveguide into the heating room. The inner waveguide including a proximal section disposed adjacent to the above-indicated one end of the outer waveguide, and a distal section extending from one end of the proximal section remote from the above one end of the outer waveguide. The distal section of the inner waveguide is inclined at a predetermined angle with respect to a longitudinal axis of the proximal section, so that the inner waveguide has a bend at the connection of the proximal and distal sections. The inner waveguide is rotated by the drive means about the longitudinal axis of the proximal section, whereby the microwave radiation is distributed from the other end of the distal section of the inner waveguide in varying directions about the axis of the proximal section.

In this embodiment, the rotation of the inner waveguide will cause the free end of its distal section to describe a circle concentric with the longitudinal axis of the proximal section, whereby the microwaves are radiated from the end of the distal section of the inner waveguide into the heating room, in all directions radially of the circule described by the distal section. As a result, the microwave radiation strikes the inner wall surfaces of the heating room, and are irregularly reflected by these surfaces. Hence, the materials which are located in the bottom portion of the heating room are evenly irradiated with the thus uniformly distributed microwave radiation.

The angle $\theta$ of inclination of the distal section relative to the proximal section of the inner waveguide may be suitably determined depending upon specific shape and construction of the heating room into which the inner waveguide projects. In general, the inclination angle $\theta$ of the distal section to the longitudinal axis of the proximal section is selected within an approximate range of 15°–45°. If the inclination angle $\theta$ is less than 15°, the inclination of the distal section may not have a satisfactory effect on the distribution of the microwave radiation in the heating room, i.e., the microwave radiation tends to be localized in a limited space in the heating room, and not uniformly distributed. If the inclination angle $\theta$ exceeds 45°, the microwave radiation tends to scatter with a result of increased energy loss and reduced heating efficiency. However, the angle of inclination $\theta$ is not confined to the above-specified range, but the principle of the present invention may be practiced with an appreciable effect, even when the angle $\theta$ is outside the specified range.

The rotating speed of the inner waveguide, more precisely the rotating speed of the inclined distal section, may be suitably selected, in view of the construction of the heating room, and depending upon the nature of properties of the material to be heated. Generally, the inner waveguide is rotated at a speed within a range of 5–100 rpm. A study by the inventors found that the optimum rotating speed for the best heating results on the material was around 30 rpm.

In the embodiment which has been described, one or more fans (with blades) may be provided in the heating room, so that the microwave radiation from the open end of the inclined distal section of the rotating inner waveguide may be irregularly reflected by such fan or fans, for furthering the uniformity of distribution of the radiated microwaves to obtain more evenness of irradiation of the material. In this case, these fans are generally located nearer to the material to be heated, than to the end of the outer waveguide. In addition to or in place of the above fans, it is advantageous to provide the four side walls or opposite side walls of the heating room, with reflector plates such as a louver plate, corrugated or bellows'-shaped plates or other plates having uneven or rough reflecting surfaces.

According to a further advantageous embodiment of the invention, the rotary reflector means further includes a radiator horn projecting from the above-indicated one end of the outer waveguide and having an increasing diameter in a direction away from the above one end of the outer waveguide, the reflector member is disposed within the radiator horn and rotated by the drive means. The reflector member and the radiator horn cooperate to cause irregular reflection of the microwave radiation in the heating room.

In the above embodiment, the microwave radiation incident to the radiator horn is stirred or irregularly reflected by the rotary reflector member disposed within the radiator horn. The irregularly reflected microwave radiation is further reflected by the inner surface of the radiator horn and by the inner wall surfaces of the heating room, whereby the microwaves are uniformly distributed for evenly irradiating all surfaces of the material which is located in the lower portion of the heating room.

The angle of opening of the radiator horn in which the rotary reflector is disposed, is suitably determined for effective radiation, dispersion and reflection of the incident microwaves, depending upon the size, configuration and construction of the heating room, so that the material may be evenly irradiated by the incident microwave radiation. Usually, the opening angle ranges from 30° to 90°. However, the principle of the invention may be practiced with an appreciable effect, even when the opening angle is outside the above-specified range. The radiator horn generally takes the form of a truncated cone, but may be a truncated pyramid.

The above-described embodiment may employ one or more fans as previously described, for furthering the uniformity of distribution of the microwave radiation. In this instance, the fan or fans are disposed so as to reflect the microwave radiation from the open end of the radiator horn. Further, the side walls of the heating room may be provided with suitable reflector plates as previously indicated.

According to a further advantageous embodiment of the invention, the drive means includes a drive shaft which extends into the heating room, passing substantially a center of the above-indicated one end of the outer waveguide. The drive shaft carries the reflector member in the heating room such that the reflector member is positioned right below the above one end of the outer waveguide.

In this embodiment wherein the drive shaft is alinged with the open end of the outer waveguide, the rotary reflector member is rotatably supported by the drive shaft, so that the reflector member may stir or irregularly reflect the microwave radiation from the end of the outer waveguide. The microwaves reflected by the rotating reflector member right below the end of the outer waveguide are reflected by the inner wall surfaces of the heating room and uniformly distributed, whereby the material at the bottom of the heating room may be evenly irradiated by the uniformly distributed microwave radiation.

The reflector member may comprise at least one rotary member which substantially blocks the microwave radiation from the outer waveguide from directly striking the material located right below the rotary member. The at least one rotary member may comprise plural members spaced from each other along the drive shaft. The plural members are arranged such that their blades do not overlap with each other in a plane perpendicular to the drive shaft.

In this arrangement, the microwave radiation from the outer waveguide is first irregularly reflected by the rotating reflector member, and subsequently reflected by the inner wall surfaces of the heating room. Thus, the microwave radiation is uniformly distributed in the heating room before the radiation reaches the material, whereby the material is evenly irradiated. In this embodiment, too, it is advantageous to provide suitable reflector plates on the inner wall surfaces of the heating room, as previously described.

BRIEF DESCRIPTION OF THE DRAWINGS

The foregoing and other objects, features and advantages of the present invention will be better understood from reading the following detailed description or preferred embodiments of the invention, when considered in conjunction with the accompanying drawing, in which:

FIG. 8 is a fragmentary elevational view in enlargement of a further embodiment of the invention, showing a rotary reflector attached to a drive shaft, disposed right below the open end of a waveguide; and FIG. 9(*a*) is a fragmentary elevational view of a modified form of the rotary reflector; and FIG. 9(*b*) is a plan view taken along line IX—IX of FIG. 9(*a*).

DETAILED DESCRIPTION OF THE PREFERRED EMBODIMENTS

To further clarify the concept of the present invention, several preferred embodiments of the invention will be described in detail, by reference to the accompanying drawing.

Figure 1:
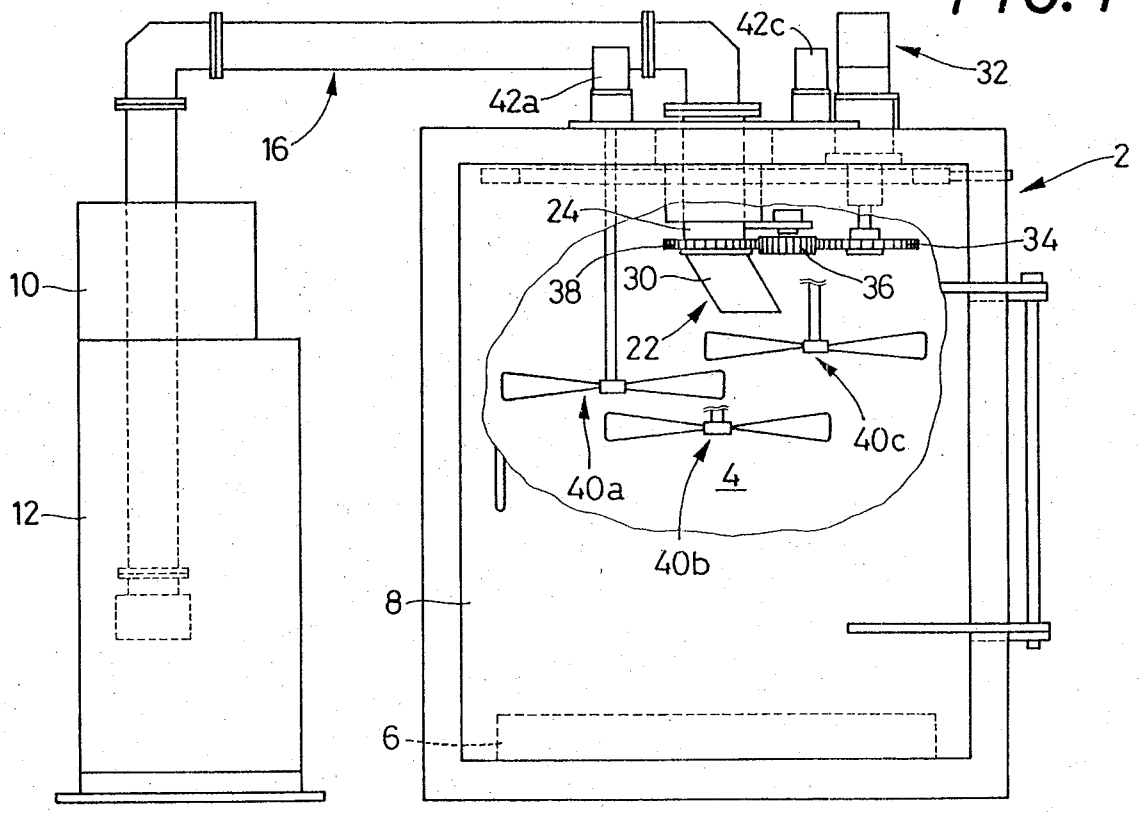
FIG. 1 is a partially cut-away front elevational view of one embodiment of a microwave heating device of the invention.
Figure 2:
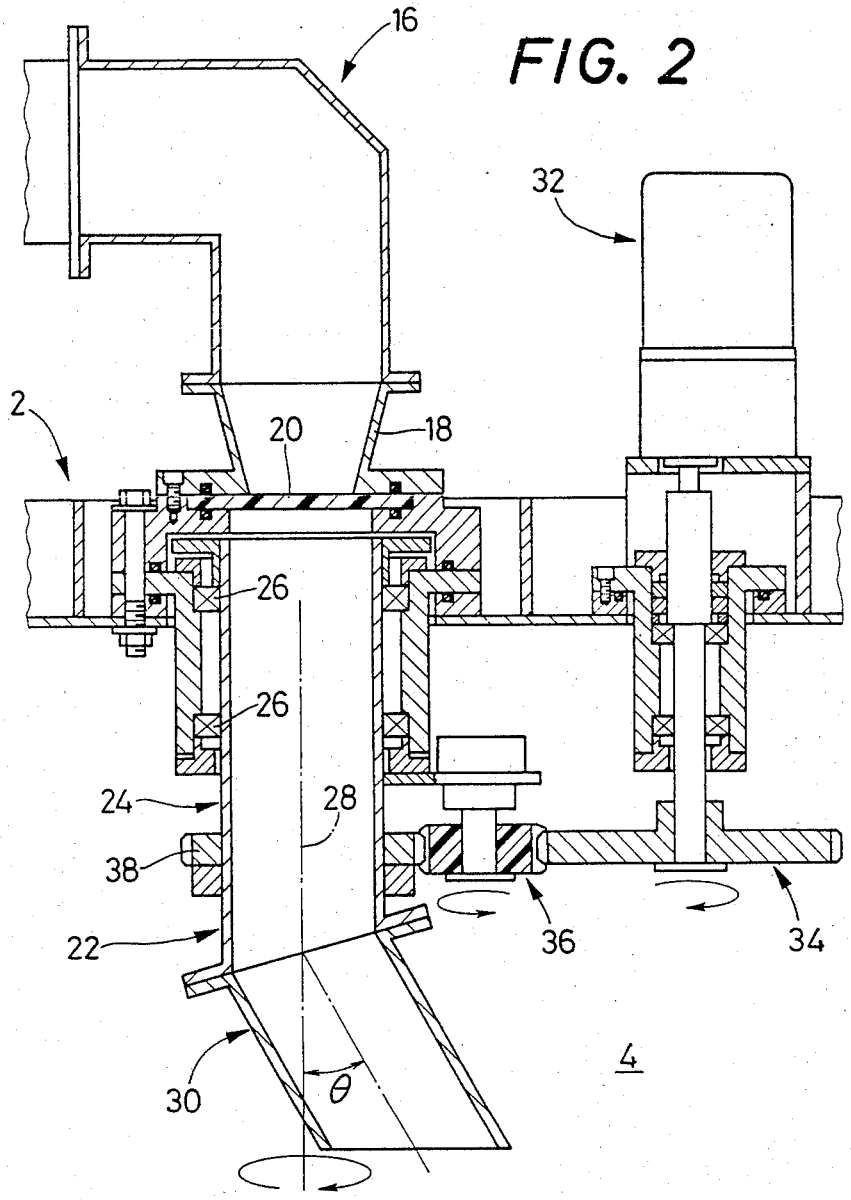
FIG. 2 is a fragmentary elevational view in enlargement of an inner waveguide and a drive mechanism for rotating the inner waveguide.

Referring first to a partially cut-away front elevational view of FIG. 1, there is shown one embodiment of a microwave heating device of the present invention, which has a waveguide arrangement whose rotating mechanism is illustrated in a fragmentary view of FIG. 2 partly in cross section. In the figures, reference numeral 2 generally designates a heating oven of enclosed structure which has a heating chamber or room 4 defined by surrounding walls. In the bottom of the heating room 4, there is disposed a stand or platform 6 on which materials or substances to be heated (hereinafter referred to as "article") are placed. An access to the heating room 4 for placing the article on the platform 6 and removing the article therefrom is obtained by opening a door 8 which closes a front opening of the heating room 4.

Adjacent to the heating oven 2, there is provided a microwave oscillator 12 equipped with a control panel 10 through which the oscillator 12 is controlled. Microwave radiation produced by the microwave oscillator 12 is channeled or guided into the heating room 4 through an outer waveguide 16 of rectangular cross section, which extends from the oscillator 12 and is connected at its one end to the heating oven 2 such that the connected end does not project in the heating room 4.

A structure connecting the outer rectangular waveguide 16 and the heating oven 2 for radiation of microwave energy into the heating room 4 is illustrated in enlargement in FIG. 2, wherein the outer rectangular waveguide 16 terminates into a tapered tube 18 of circular cross section which is attached to the top of the heating oven 2, such that the tapered tube 18 is aligned with a hole formed in the the ceiling of the oven 2. For maintaining air-tightness between the outer waveguide 16 and the heating room 4, the above-indicated hole is closed by a seal plate 20 of silicone resin or similar material which allows the transmission of the microwave radiation therethrough.

On the inner side of the seal plate 20 opposite to the tapered tube of the outer waveguide 16, an inner waveguide 22 of circular cross section is attached to the ceiling of the heating oven 2 such that the upper end of the inner waveguide 22 and the lower end of the tapered tube 18 are positioned opposite to each other. The inner waveguide 22 consists of a proximal section in the form of an upper upright section 24, and a distal section in the form of a lower slant section 30. The inner waveguide 22 extends a suitable distance into the heating room 4 so that the lower end of the slant section 30 is open in the heating room 4. The upper upright section 24 is positioned coaxially with the tapered tube 18, and is supported by bearings 26 rotatably about its longitudinal axis 28. The lower slant section 30 is connected to the upper upright section 24 such that the axis of the lower section 30 is inclined at an angle $\theta$ with respect to the axis 28 of the upper section 24, as indicated in FIG. 2. Thus, the inner waveguide 22 has a bend at the mating ends of the upright and slant sections 24, 30.

On the ceiling of the heating oven 2, there is mounted a motor 32 which serves as drive means for rotating the inner waveguide 22, as hereinafter described in detail. The power of the motor 32 is imparted to the inner waveguide 22 through a gear train which consists of: a gear 34 which is supported in the heating room 4 and driven by the motor 30; an intermediate gear 36 made of fluororesin or like materials mating with the gear 34; and a gear 38 which is secured to the outer circumferential surface of the upper upright section 24 of the inner waveguide 22 and engages the intermediate gear 36. In this arrangement, the rotary motion of the drive motor 32 is transmitted to the upper upright section 24, whereby the inner waveguide 22 is rotated about the longitudinal axis 28 of the upright section 24, i.e., about the axis 28 of the proximal section 24.

As shown in FIG. 1, the instant microwave heating device is provided with three fans 40*a*, 40*b* and 40*c* for causing irregular reflection of the microwave radiation incident to the heating oven 2. These fans 40*a*, 40*b*, 40*c* are disposed in the heating room 4 such that they are located below the inner waveguide 22 and are substantially equally spaced from each other circumferentially of the upright section 24 about the longitudinal axis 28. Further, the three fans 40*a*, 40*b*, 40*c* are disposed at different vertical positions, i.e., at different heights from the platform 6. The fans 40*a*, 40*b*, 40*c* are driven by respective motors 42*a*, 42*b* (not shown), 42*c* which are mounted on the ceiling of the heating oven 2.

In the microwave heating device constructed as described hitherto, the microwaves generated by the microwave oscillator 12 is channeled or guided into the heating room 4 of the heating oven 2, through the outer waveguide 16 connected to the heating oven 2, and through the inner waveguide 22 while it is rotated by the motor 32. The microwaves incident to the inner waveguide 22 are partially reflected by the inner surfaces of the inner waveguide 22 prior to radiation into the heating room 4. It is noted that the rotation of the lower slant section 30 causes its lower open end to take a circular path concentric with the axis 28 of the upright section 24, whereby the microwaves radiated from the lower open end of the slant section 30 are radiated in all directions radially of the circular path and strike different surfaces of the side walls of the heating room 4. As a result, the microwave radiation introduced in the heating room 4 is irregularly reflected by the various wall surfaces and uniformly distributed over all surfaces of the article on the platform 6. That is, the article is uniformly irradiated by the microwave irregularly reflected within the heating room 4.

Thus, the inner waveguide 22 and the drive system including the motor 32 constitute rotary reflector means for uniformly distributing the incident microwave radiation in the heating room 4.

The uniformity of distribution of the microwaves in the heating room 4 as a result of rotary movements of the inner waveguide 22, and the uniformity of irradiation of the article are further enhanced by means of the rotating movements of the three fans 40*a*, 40*b*, 40*c* below the inner waveguide 22. The rotary motions of the reflector fans 40*a*, 40*b*, 40*c* cause turbulence of the microwave radiation from the inner waveguide 22. Furthermore, the air-tight junction between the outer waverguide 16 and the inner waveguide 22 by means of the seal plate 22 makes it possible to maintain the heating room 4 under a vacuum condition. In this instance, the microwave heating of an article (material or substance) may be done in a constant environment, which is favourable for better heating effects.

Further, it is advantageous to provide suitable reflector plates (not shown) on the inner surfaces of the four side walls or two opposite side walls of the heating room 4 for improving the distribution of the microwaves for uniform irradiation of the article. Also, it is advantageous that the ceiling and/or four sides of the heating oven 2 be double-walled so that a space in the double-walled structure is charged with a heated air or steam of 50°–120° C., or ohter suitable heat-loaded substance, in order to prevent dewing on the ceiling or side walls. Further, the heating oven 2 may preferably be equipped with an evacuation device, as needed.

The configuration of the inner waveguide 22, and the arrangement for rotating the inner waveguide may be modified as desired, without departing from the spirit of the invention. An example of modified arrangements of the inner waveguide is illustrated in FIG. 3.

Figure 3:
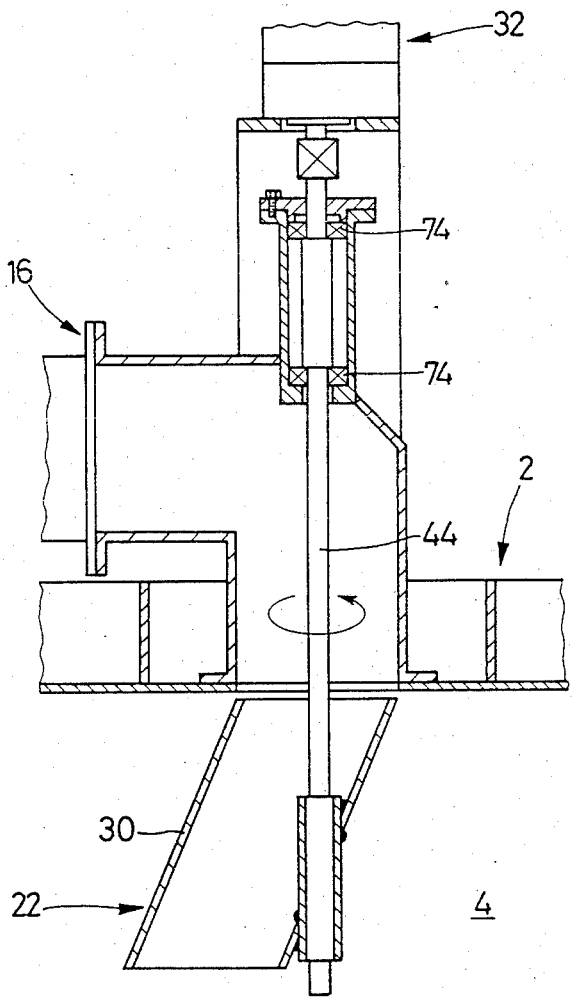
FIG. 3 is a view corresponding to FIG. 2, illustrating a modified form of the inner waveguide and its drive mechanism.

Unlike the waveguide 22 of the preceding embodiment, the modified inner waveguide 22 of FIG. 3 consists solely of the slant section 30, that is, the entire length of the inner waveguide 22 is inclined relative to the vertical. More specifically, the slant inner waveguide 22 is disposed such that its upper open end is opposite to the open end of the outer waveguide 16 which is attached to the ceiling wall of the heating oven 2. A drive shaft 44 for rotating the inner waveguide 22 is rotatably supported by bearings 74, 74 outside the heating oven 2. The drive shaft 44 passes the center of the open end of the outer waveguide 16 and extends vertically through the end portion of the outer waveguide 16, and projects into the heating room 4. The inner waveguide 22 is connected to the drive shaft 44 such that the shaft 44 passes the center of the upper open end of the inner waveguide 22 while the longitudinal axis of the inner waveguide 22 is inclined at a suitable angle $\theta$ with respect to the drive shaft 44. The drive shaft 44 supported by the bearings 74, 74 is driven by the motor 32.

In the above arrangement, the rotation of the drive shaft 44 will cause the inner waveguide 22 (corresponding to the slant section 33 of FIG. 2) to be rotated about the drive shaft 44 while its upper open end held in alignment with the open end of the outer waveguide 16 attached to the heating oven 2. Consequently, the microwaves which are guided through the outer waveguide 16 are radiated through the rotating inner waveguide 22 and distributed uniformly into the heating room 4. Therefore, the article on the platform 6 may be evenly exposed to the microwave radiation, as in the preceding embodiment. In the instant embodiment, too, the inner waveguide 22 and the drive system including the motor 32 constitute rotary reflector means for uniform distribution of the incident microwave radition in the heating room 4.

Figure 4:
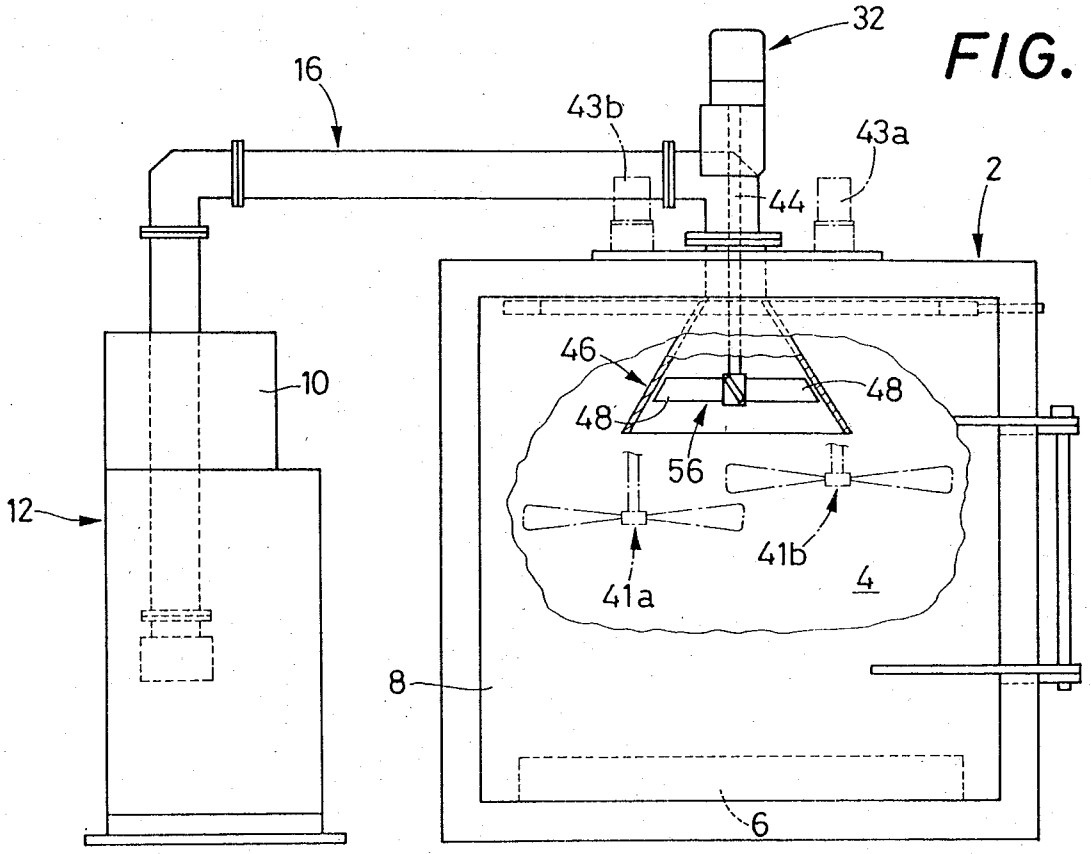
FIG. 4 is a partially cut-away front elevational view of another embodiment of the microwave heating device of the invention.
Figure 5:
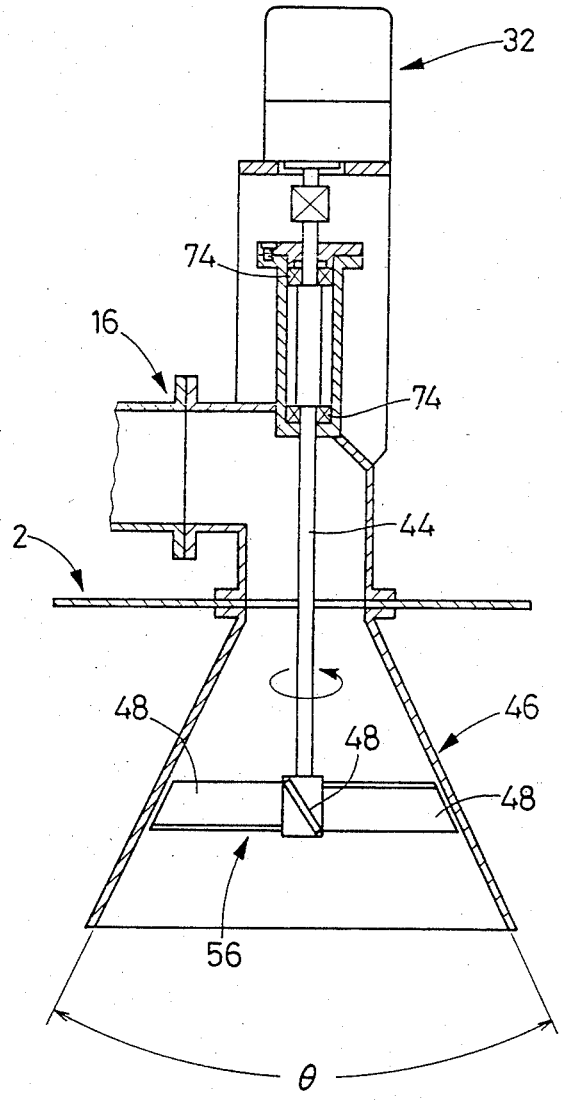
FIG. 5 is a fragmentary elevational view in enlargement of a radiator horn and a rotary reflector.

There is shown in a partially cut-away elevational view of FIG. 4 another embodiment of the microwave heating device of the invention, the outer waveguide 16 of which is provided at its end with a radiator horn 46 as illustrated in enlargement in a fragmentary view of FIG. 5.

The open end of the outer waveguide 16 attached to the ceiling of the heating oven 2 is connected to the radiator horn 46 which has a diameter increasing from its upper end adjacent to the ceiling of the oven 2, toward its lower end, so as to form a suitable opening angle $\theta$ as shown in FIG. 5.

The radiator horn 46 accommodates a rotary reflector 56 which is secured to the lower free end of the drive shaft 44 which extends through the end portion of the outer waveguide 16 and the ceiling of the heating oven 2, coaxially with the horn 46. The rotary reflector 56 has four blades 48 which are equiangularly spaced from each other at angular intervals of 90° in the direction of rotation of the drive shaft 44. As previously described, the drive shaft 44 is rotatably supported by the bearings 74, 74 and rotated by the motor 32 about its axis. The rotation of the drive shaft 44 will cause the rotary reflector 56 to be rotated within the radiator horn 46.

The instant embodiment of the microwave heating device also employs fans 41*a*, 41*b* similar to the fans 40*a*, 40*b*, 40*c* used in the first embodiment of FIG. 1, the fans 41*a*, 41*b* being driven by respective motors 43*a*, 43*b* for causing irregular reflection of the microwave radiation from the radiator horn 46. Like the fans 40*a*, 40*b*, 40*c*, the fans 41*a*, 41*b* are disposed at different heights from the platform 6.

In the microwave heating device of FIGS. 4 and 5, the microwaves generated from the microwave oscillator 12 and travelling through the outer waveguide 16 are led into the radiator horn 46, in which the microwaves strike the surfaces of the blades 48 of the rotating rotary reflector 56. The microwave radiation reflected by the blades 48 are then reflected by the tapered inner surface of the radiator horn 46, and thus radiated into the heating room 4. Accordingly, the microwave radiation from the radiator horn 46 is uniformly distributed over the surfaces of the article on the platform 6. Thus, the article is evenly irradiated through uniform microwave distribution. Thus, the radiator horn 46, the rotary reflector 56 and the drive system including the motor 32 constitute rotary reflector means for uniform distribution of the incident microwave radiation in the heating room 4.

The uniformity of distribution of the microwaves in the heating room 4 by the radiator horn 46 and the rotary reflector 56, and the uniformity of irradiation of the article are further enhanced by means of the rotating movements of the fans 41*a*, 41*b* disposed below the inner waveguide 22. The rotary motions of the rotary reflector fans 41*a*, 41*b* cause turbulence of the microwave radiation from the inner waveguide 22.

Further, as previously stated, it is advantageous to provide suitable reflector plates (not shown) on the inner surfaces of the four side walls or two opposite side walls of the heating room 4 for improving the distribution of the microwaves for uniform irradiation of the article. Also, it is advantageous that the ceiling and/or four sides of the heating oven 2 be double-walled so that a space in the double-walled structure is charged with a heated air or steam of 50°–120° C., or other suitable heat-loaded substance, in order to prevent dewing on the ceiling or side walls. Further, the heating oven 2 may preferably be equipped with an evacuation device, as needed.

While the embodiment of FIGS. 4 and 5 uses the rotary reflector 56 as a rotary reflector member disposed within the radiator horn 46, it is possible to use other various types of stirring members or arrangements known in the art, such as planar, half-cut, or cylindrical member or members, which may occur to those skilled in the art without departing from the spirit of the invention. Some of such modified rotary reflector members are illustrated in FIG. 6, and FIGS. 7(*a*) and 7(*b*).

Figure 6:
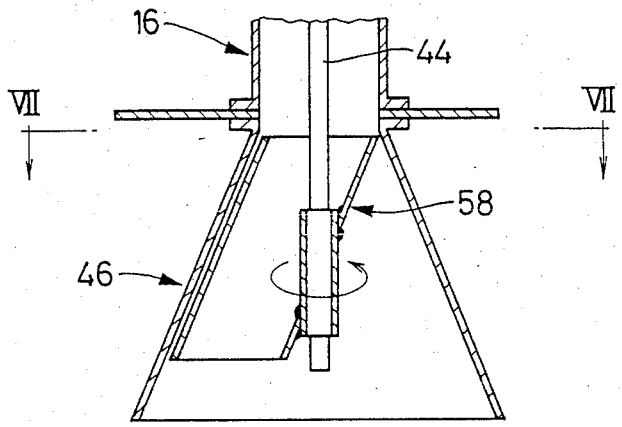
FIG. 6 is a view corresponding to FIG. 5, showing a modified form of the rotary reflector disposed in the radiator horn.

In the modified embodiment of FIG. 6, a rotary reflector 58 of cylindrical or tubular configuration is disposed in the radiator horn 46 such that the longitudinal axis of the cylinder of the reflector 58 is inclined along the tapered wall of the horn 46, with the upper open end held in alignment with and opposite to the the open end of the outer waveguide 16. In this arrangement, the rotary reflector 58 serves as an inner waveguide similar to the inner waveguide 22 shown in FIG. 3. As previously described, the rotation of the drive shaft 44 will cause the rotary reflector 58 to be rotated within the horn 46, in the same manner as the inner waveguide 22 of FIG. 3, whereby the microwaves which are introduced into the rotary reflector 58 are uniformly distributed in the heating room 4. As a result, otherwise possible uneven irradiation of the article on the platform 6 at the bottom of the heating room 4 may be effectively avoided. It is noted that the microwaves incident to the rotary reflector 58 are partially reflected by the inner surface of the reflector 58 and by the inner surface of the radiator horn 46.

Figure 7:
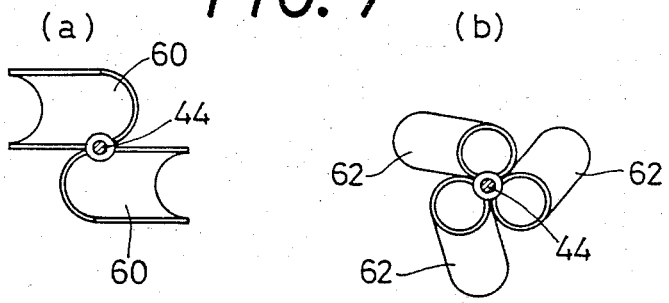
FIGS. 7(*a*) and 7(*b*) are plan views of further modified forms of the rotary reflector, corresponding to views taken along line VII—VII of FIG. 6.

A rotary reflector shown in FIG. 7(*a*) comprises a pair of longitudinally-split cylinder halves 60 which are secured to the drive shaft 44 so that the two halves 60 are diametrically opposite to each other with respect to the drive shaft 44., Another modified rotary reflector shown in FIG. 7(*b*) comprises three cylinders 62 which are secured to the drive shaft 44 in equally spaced relation with each other circumferentially of the drive shaft. As previously indicated, by the rotary movements of these rotary reflectors 60, 62 within the radiator horn 46, the incident microwaves are radiated from the horn 46 into the heating room 4 in varying directions, that is, uniformly distributed in the heating room 4, so as to evenly irradiate the article on the platform 6.

A still further embodiment of the present invention will be described, referring to a fragmentary cross sectional view of FIG. 8 which shows a part of a microwave heating device, at which the end of the outer waveguide 16 is open to the heating room 4.

In the figure, the drive shaft 44 extends through the end portion of the outer waveguide 16, passing substantially the center of the open end of the waveguide 16 and penetrating the ceiling of the heating oven 2, so that the lower end of the shaft 44 projects in the heating room 4 by a suitable distance. The drive shaft 44 carries at its lower end a rotary reflector 64, which has four blades equally spaced (at angular intervals of 90°) from each other circumferentially of the drive shaft 44. The drive shaft 44 is rotatably supported at its upper end portion by the bearings 74, 74, and driven by the motor 32. Thus, the rotary reflector 64 are rotatable right below the open end of the outer waveguide 16.

In the above embodiment, the microwaves from the microwave oscillator 12 are introduced into the heating oven 2 through the outer waveguide 16, and strike the blades 50 of the rotating rotary reflector 64 disposed below the open end of the outer waveguide 16, whereby the incident microwave radiation is irregularly reflected by the blades 50, and thus uniformly distributed in the heating room 4. Consequently, all surfaces of the article placed on the platform 6 at the bottom of the heating room 4 may be evenly irradiated by the uniformly distributed microwaves.

In particular, the turbulence or irregular reflection of the incident microwaves may be achieved effectively because of the location of the rotary reflector 64. Namely, the drive shaft 44 is disposed so as to extend through the end portion of the outer waveguide 16, and the rotary reflector 64 is positioned right below the open end of the outer waveguide 16 from which the microwaves are radiated into the heating room 4. This arrangement permits more effective irregular reflection of the incident microwave radiation, than a conventional arrangement wherein irregular reflection is effected by only some of a plurality of blades of a reflector fan or fans. In the instant arrangement, however, at least a portion of each blade 50 of the reflector 64 contributes to the irregular reflection of the microwaves within the heating room 4. That is, the rotary reflector 64 has a relatively large area for irregular reflection of the microwave radiation, which results in increased chance of irregular reflection of the microwave radiation, and consequently improved uniformity of the microwave distribution within the heating room 4, enabling the article to be evenly irradiated.

In this embodiment, too, it is advantageous to provide suitable reflector plates (not shown) in the form of a louver board or plates having corrugated, bellows-shaped or other uneven surfaces, on the inner surfaces of the four side walls or two opposite side walls of the heating room 4 for improving the distribution of the microwaves for uniform irradiation of the article. Further, as also described previously, the ceiling and/or four sides of the heating oven 2 may be double-walled so that a space in the double-walled structure is charged with a heated air or steam of 50°–120° C., or other suitable heat-loaded substance, in order to prevent dewing on the ceiling or side walls. Further, the heating oven 2 may preferably be equipped with an evacuation device, as needed.

While the rotary reflector 64 having the plural blades 50 of generally planar configuration is used in the embodiment of FIG. 8, it is possible to employ other types of rotary reflector members such as those shown in FIGS. 7(*a*) and 7(*b*). Further, the rotary reflector 64 may be replaced by a set of two reflector members 64, 66 as illustrated in FIGS. 9(*a*) and 9(*b*).

In the figures, the two rotary reflectors 64, 66 are attached to the lower end portion of the drive shaft 44 in spaced-apart relation with each in the longitudinal direction of the shaft. These two rotary reflectors 64, 66 are positioned circumferentially of the drive shaft 44 so that four blades 52 of the upper reflector 64 do not overlap four blades 54 of the lower reflector 66 in a plane perpendicular to the drive shaft 44. The blades 52, 54 of the reflectors 64, 66 are substantially equiangularly spaced from each other (at angular intervals of about 90°). Therefore, the blades 52 are spaced from the blades 54 at angular intervals of about 45°.

With the blades 52, 54 positioned as described above, the area defined by the eight blades 52, 54 covers the entire cross sectional area 70 of the open end of the outer waveguide 16, as illustrated in FIG. 9(*b*). Accordingly, the microwaves radiated downward from the open end of the outer waveguide 16 strike radially inner portions of the individual blades 52, 54, and thus substantially blocked from directly striking the article which is located right below the set of the two superposed rotary reflectors 64, 66. In other words, the microwave radiation from the outer waveguide 16 is irregulaly reflected by the blades 52, 54 of the rotating reflectors 64, 66 before the microwaves are reflected by the inner surfaces of the heating room 4. In this way, the microwave radiation is uniformly distributed within the heating room 4, and the article is uniformly irradiated by the uniformly distributed microwave radiation.

While the present invention has been described in its preferred embodiments, all in the form of a box type microwave heating device for batch processing of materials, the invention may be equally suitably applied to a continuous heating process. In this instance, the heating device is generally provided with a stationary heating room in which there is disposed a rotary inner waveguide, a radiator horn equipped with a rotary reflector, or a rotary reflector positioned right below the end of an outer waveguide, so that the inner waveguide or rotary reflector is rotatable by a motor or other suitable drive means. Further, the heating device is provided with a conveyor on which materials or substances to be heated are placed for irradiation by the microwaves while the materials on the conveyor are continuously moved, passing through the heating room.

It will be obvious that the invention may be otherwise embodied with various changes, modifications and improvements, which may occur to those skilled in the art without departing from the spirit and scope of the invention defined in the appended claims.

What is claimed is:

1. A microwave heating device for heating a material, comprising:

a microwave oscillator for producing microwave radiation for heating said material;

a heating room;

an outer waveguide for channeling the microwave radiation from said microwave oscillator into said heating room, said outer waveguide having a first end which is in communication with said heating room; and a rotary reflector comprising a cylindrical inner waveguide projecting from said first end of the outer waveguide into said heating room to receive the microwave radiation from the outer waveguide and for reflecting the microwave radiation, and further comprising drive means for rotating said inner waveguide to cause irregular reflection of the microwave radiation, said inner waveguide including a proximal section disposed adjacent to said first end of the outer waveguide and a distal section extending from said proximal section remote from said first end of the outer waveguide, said distal section being inclined at an angle relative to a longitudinal axis of said proximal section, said inner waveguide being rotated by said drive means about said longitudinal axis of the proximal section, whereby the microwave radiation is distributed from said distal section of the inner waveguide in varying directions about said longitudinal axis.

2. The microwave heating device according to claim 1, further comprising fan means disposed below said inner waveguide, and another drive means for rotating said fan means.

3. The microwave heating device of claim 1 wherein said relative angle is between 15° and 45°.

4. A microwave heating device for heating a material, comprising:

a microwave oscillator for producing microwave radiation for heating said material;

a heating room in which a material to be heated is placed;

an outer waveguide for channeling the microwave radiation from said microwave oscillator into said heating room, said outer waveguide including a first end which is in communication with said heating room; and a reflector means disposed adjacent to said first end of the outer waveguide for uniformly distributing said microwave radiation in said heating room, said reflector means comprising a stationary radiator horn projecting from said first end of the outer waveguide and having an increasing diameter in a direction away from said first end of the outer waveguide, and a rotary reflector member disposed within one said radiator horn to receive said microwave radiation from said outer waveguide and for reflecting the microwave radiation, and drive means for rotating said rotary reflector member, said radiator horn and said rotary reflector member cooperating to cause irregular reflection of the microwave radiation.

5. The microwave heating device according to claim 4, further comprising a fan means which is disposed below said radiator horn and said rotary reflector member, and another drive means for rotating said fan means.

6. A microwave heating device for heating a material, comprising:

a microwave oscillator for producing microwave radiation for heating said material;

a heating room having sidewalls and a bottom portion;

an outer waveguide for channeling the microwave radiation from said microwave oscillator into said heating room, said outer waveguide including a first end which is in communication with said heating room; and a reflector means disposed adjacent to said first end of the outer waveguide, said reflector means comprising a rotary reflector member positioned to direct the microwave radiation such that at least a substantial portion of said microwave radiation directly reflects off of said sidewall of the heating room, and a drive means for rotating said rotary reflector member to cause irregular reflection of the microwave radiation, said reflector means comprising an inner waveguide having an open end with a center, said inner waveguide being supported by a drive shaft of said drive means such that the drive shaft passes through said center of said open end of the inner waveguide opposite to said first end of said outer waveguide, said inner waveguide being secured to said drive shaft such that a longitudinal axis of the inner waveguide is inclined at a predetermined angle relative to the drive shaft, said drive shaft passing substantially through a center of said first end of the outer waveguide, said rotary reflector member being positioned directly below said first end of the outer waveguide.

7. A microwave heating device according to claim 6, wherein said rotary reflector member comprises a fan means disposed below said inner waveguide and another drive means for rotating said fan means to permit uniform distribution of the microwave radiation from said inner waveguide.

* * * * *